US008484778B2

(12) United States Patent
Heimbrock et al.

(10) Patent No.: US 8,484,778 B2
(45) Date of Patent: Jul. 16, 2013

(54) SIDE RAIL WITH TWO POSITION STORAGE FEATURE

(75) Inventors: Richard H. Heimbrock, Cincinnati, OH (US); Stephen Hutchison, Batesville, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 144 days.

(21) Appl. No.: 12/876,588

(22) Filed: Sep. 7, 2010

(65) Prior Publication Data

US 2012/0054961 A1 Mar. 8, 2012

(51) Int. Cl.
*A47C 21/08* (2006.01)

(52) U.S. Cl.
USPC ..... 5/430; 5/425

(58) Field of Classification Search
USPC ..... 5/425, 428, 430, 100, 424, 658, 662
See application file for complete search history.

(56) References Cited

U.S. PATENT DOCUMENTS

| | | | | |
|---|---|---|---|---|
| 5,878,457 | A | 3/1999 | Cox et al. | |
| 6,701,554 | B2 | 3/2004 | Heimbrock | |
| 6,829,793 | B2 | 12/2004 | Brooke et al. | |
| 7,412,734 | B2 | 8/2008 | Stryker et al. | |
| 2006/0195984 | A1 | 9/2006 | Hakamiun et al. | |
| 2007/0136949 | A1 | 6/2007 | Richards et al. | |
| 2008/0127415 | A1 | 6/2008 | Ruschke et al. | |
| 2009/0229049 | A1 | 9/2009 | Heimbrock et al. | |
| 2011/0113549 | A1 * | 5/2011 | Riddiford et al. | 5/95 |

* cited by examiner

*Primary Examiner* — Peter M Cuomo
*Assistant Examiner* — Brittany Wilson
(74) *Attorney, Agent, or Firm* — Jason Penninger

(57) ABSTRACT

A siderail assembly comprises a first siderail body and a second siderail body. The second siderail body is movably coupled to the first siderail body and configured to rotate between a first position and a second position with respect to the first siderail body about a rotational axis passing through the first siderail body. The second siderail body is positioned above the first siderail body in the first position and below the first siderail body in the second position.

20 Claims, 8 Drawing Sheets

SIDE RAIL WITH TWO POSITION STORAGE FEATURE

BACKGROUND OF THE DISCLOSURE

This disclosure relates generally to a siderail assembly. More particularly, but not exclusively, one illustrative embodiment relates to a siderail assembly with a grip portion that is movable between a deployed position and a storage position with respect to the siderail body.

Siderails can be used with person-support apparatuses, such as, hospital beds, stretchers, etc. The siderails can be moved between a deployed position and a storage position. In some storage positions, a portion of the siderail can come into contact the lower extremities of a person ingressing/egressing to/from the side of the person-support apparatus. While various siderail assemblies have been developed, there is still room for improvement. Thus a need persists for further contributions in this area of technology.

SUMMARY OF THE DISCLOSURE

The present disclosure includes one or more of the features recited in the appended claims and/or the following features which, alone or in any combination, may comprise patentable subject matter.

One illustrative embodiment of the present disclosure can include a siderail assembly having a siderail body and a grip movably coupled to the siderail body that can be configured to rotate between an upper position and a lower position with respect to the siderail body.

Additional features alone or in combination with any other feature(s), including those listed above and those listed in the claims and those described in detail below, can comprise patentable subject matter. Others will become apparent to those skilled in the art upon consideration of the following detailed description of illustrative embodiments exemplifying the best mode of carrying out the invention as presently perceived.

BRIEF DESCRIPTION OF THE DRAWINGS

Referring now to the illustrative examples in the drawings, wherein like numerals represent the same or similar elements throughout.

DETAILED DESCRIPTION OF THE DRAWINGS

Figure 1:
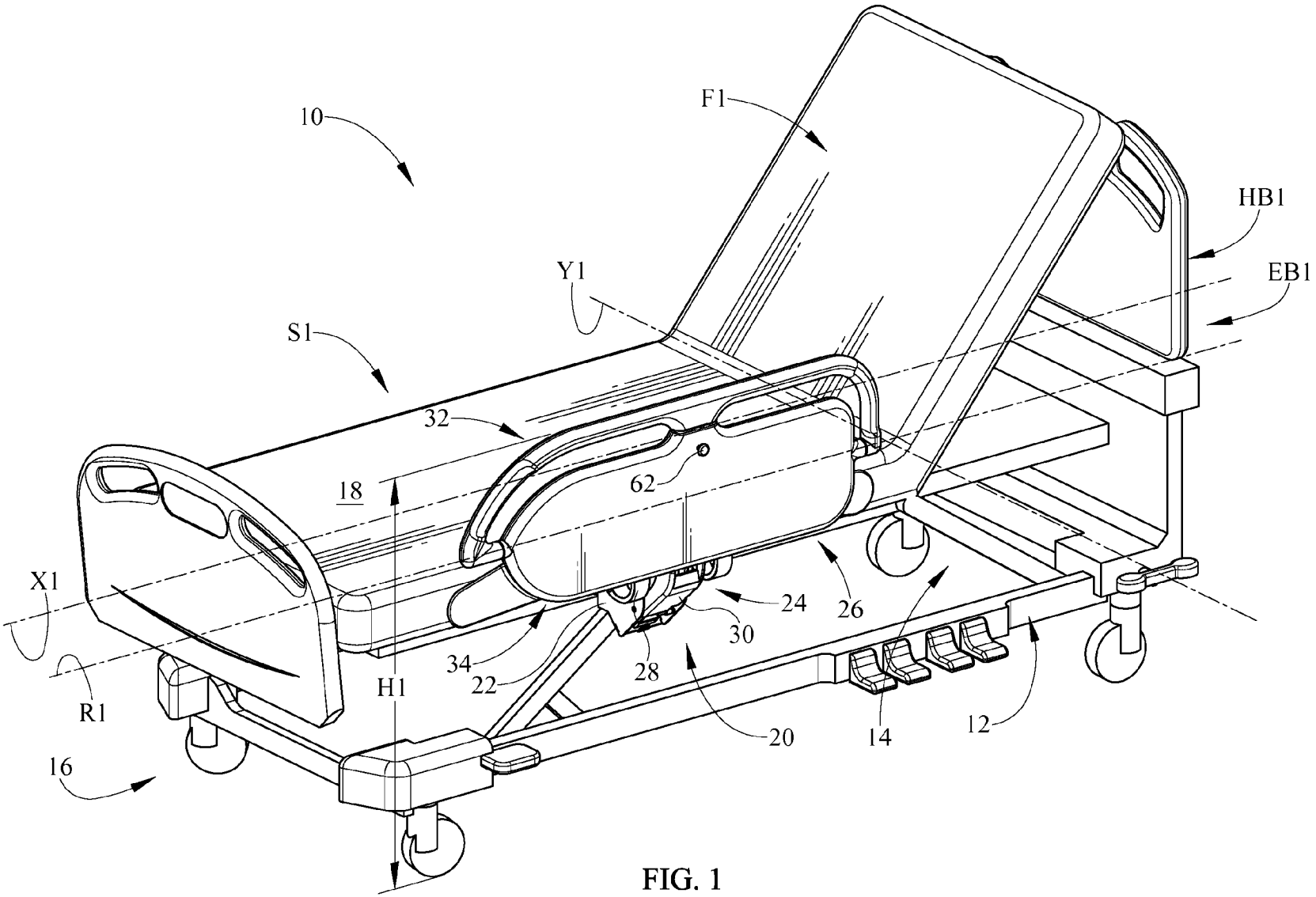
FIG. 1 is a perspective side view of a person-support apparatus according to one embodiment of the current disclosure with a siderail coupled thereto.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

One illustrative embodiment of the present disclosure can include a siderail assembly having a siderail body and a grip movably coupled to the siderail body that can be configured to rotate between an upper position and a lower position with respect to the siderail body.

A person-support apparatus 10 according to one illustrative embodiment of the current disclosure is shown in FIGS. 1-8. The person-support apparatus 10 includes a first section F1 or head support section F1, where the head of a person (not shown) can be positioned, and a second section S1 or a foot support section S1, where the feet of the person (not shown) can be positioned. In one illustrative embodiment, the person-support apparatus 10 is a hospital bed. It should be appreciated that the person-support apparatus 10 can also be a stretcher, an operating table, or other apparatus configured to support a person. The person-support apparatus includes a lower frame 12 or base 12, a plurality of supports 14 coupled to the lower frame 12, and an upper frame 16 supported on the plurality of supports 14 above the lower frame 12. It should be appreciated that the supports 14 can be lift mechanisms 14 that can move the upper frame 16 with respect to the lower frame 12. It should also be appreciated that in one illustrative embodiment the person-support apparatus 10 can support a person-support surface 18 on the upper frame 16.

The upper frame 16 includes a plurality of siderails 20 and endboards EB1 coupled thereto as shown in FIGS. 1-4. It should be appreciated that the endboards EB1 can be a headboard HB1 and/or a footboard (not shown), coupled to the first section F1 and the second section S1 of the person-support apparatus 10, respectively. The siderails 20 include a siderail base 22, a movement mechanism 24, and a siderail body assembly 26. The siderail base 22 is configured to couple the siderail 20 to the upper frame 16. The movement mechanism 24 is coupled to the siderail base 22 and is configured to move the siderail body assembly 26 between a deployed position and a storage position with respect to the upper frame 16. The movement mechanism 24 includes a linkage assembly 28 and a locking mechanism 30. The locking mechanism 30 is configured to selectively maintain the siderail body assembly 26 in the deployed position and/or the storage position.

Figure 2:
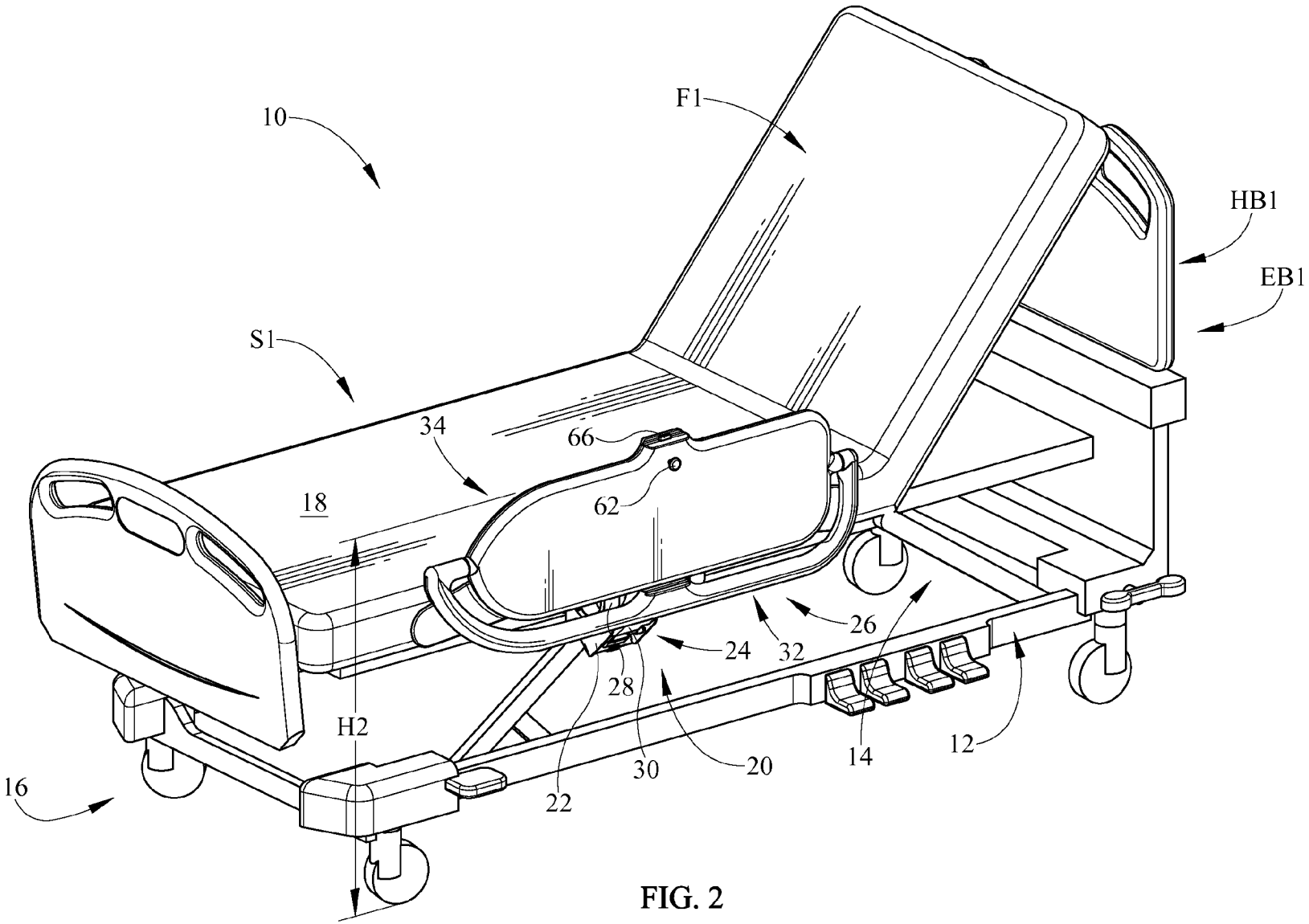
FIG. 2 is a perspective side view of the person-support apparatus of FIG. 1 showing the siderail body assembly in the deployed position with the first body in a second position with respect to the second body.
Figure 3:
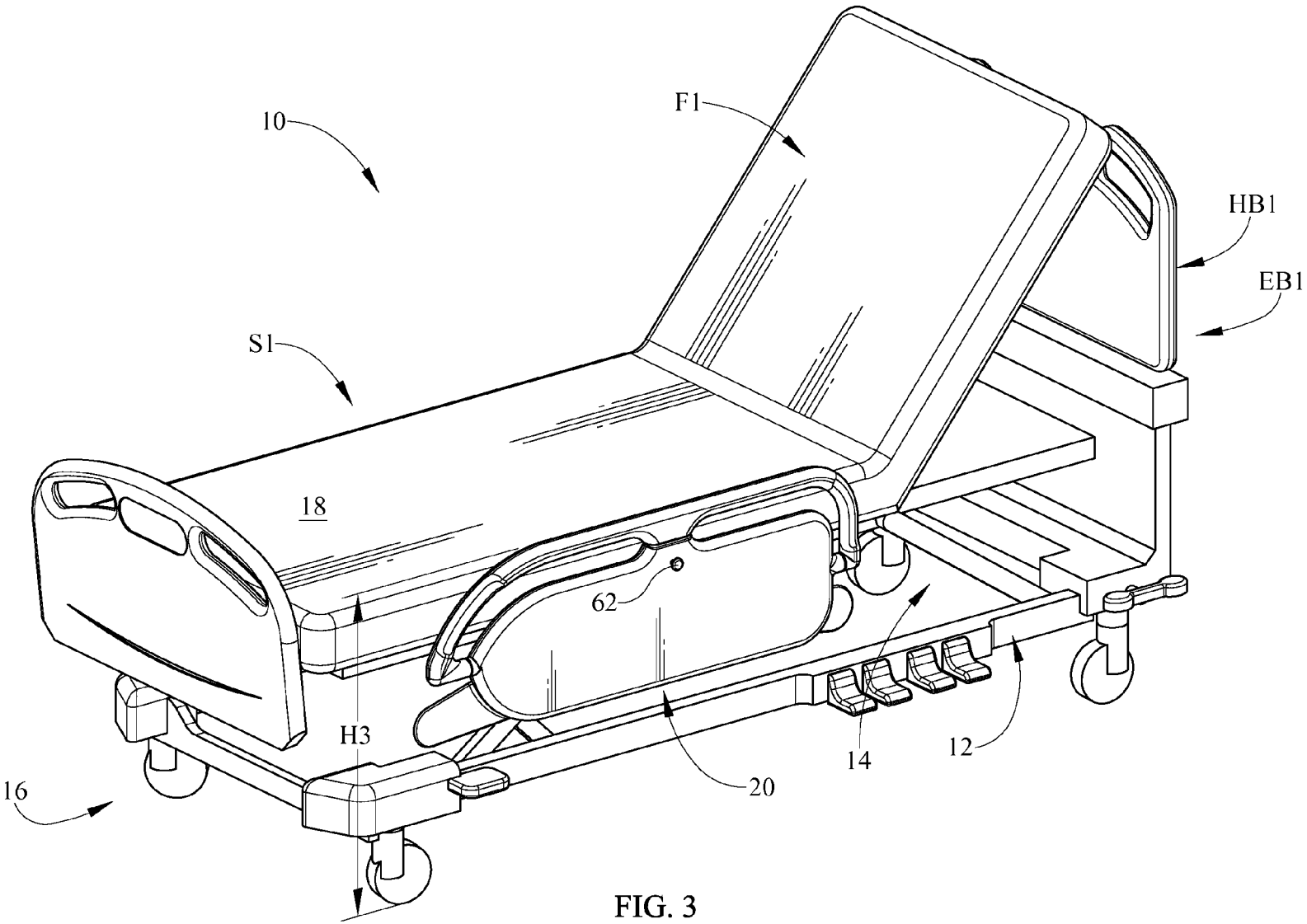
FIG. 3 is a perspective side view of the person-support apparatus of FIG. 1 showing the siderail body assembly in the storage position with the first body in a first position with respect to the second body.
Figure 4:
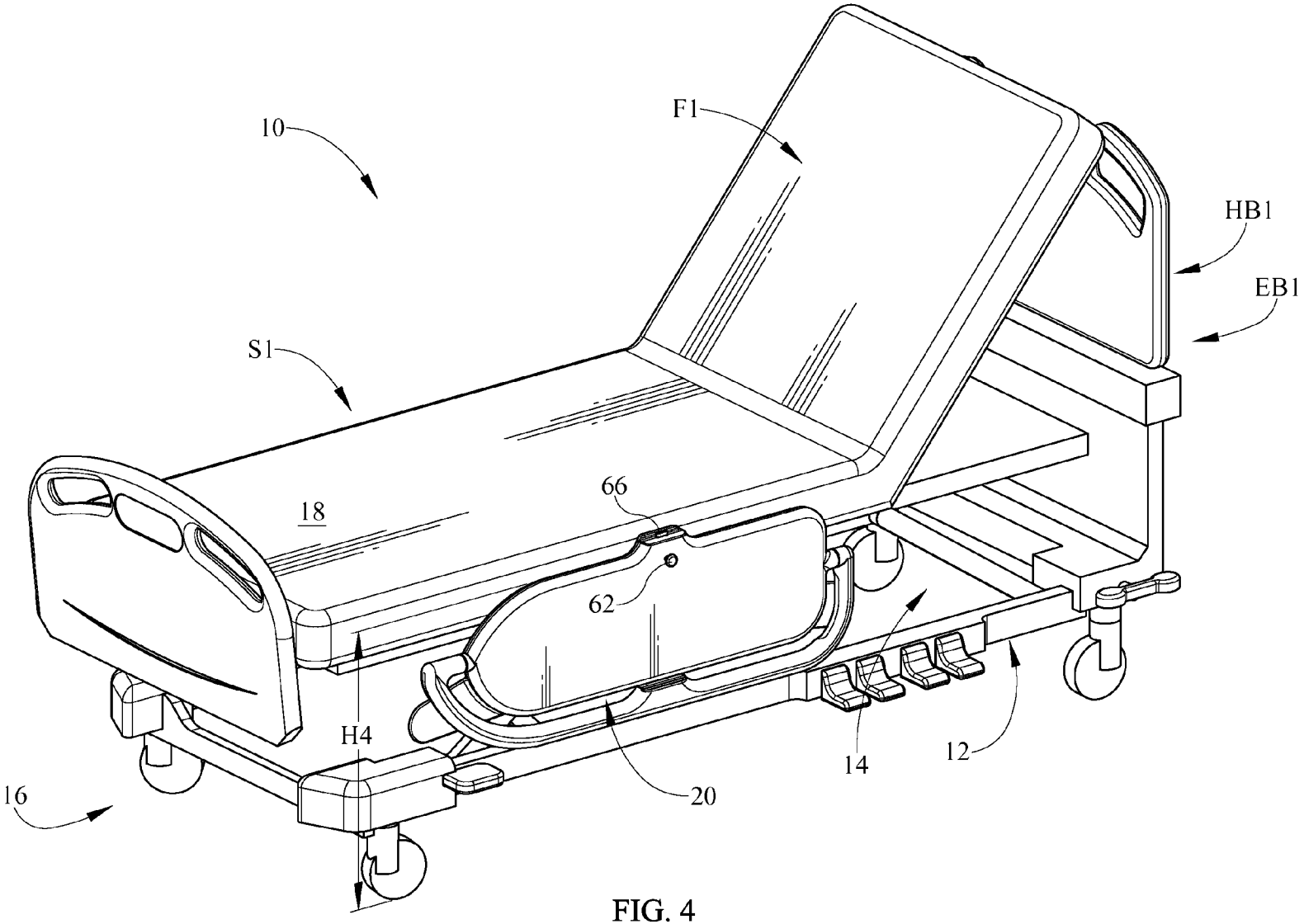
FIG. 4 is a perspective side view of the person-support apparatus of FIG. 1 showing the siderail body assembly in the storage position with the first body in the second position with respect to the second body.
Figure 5:
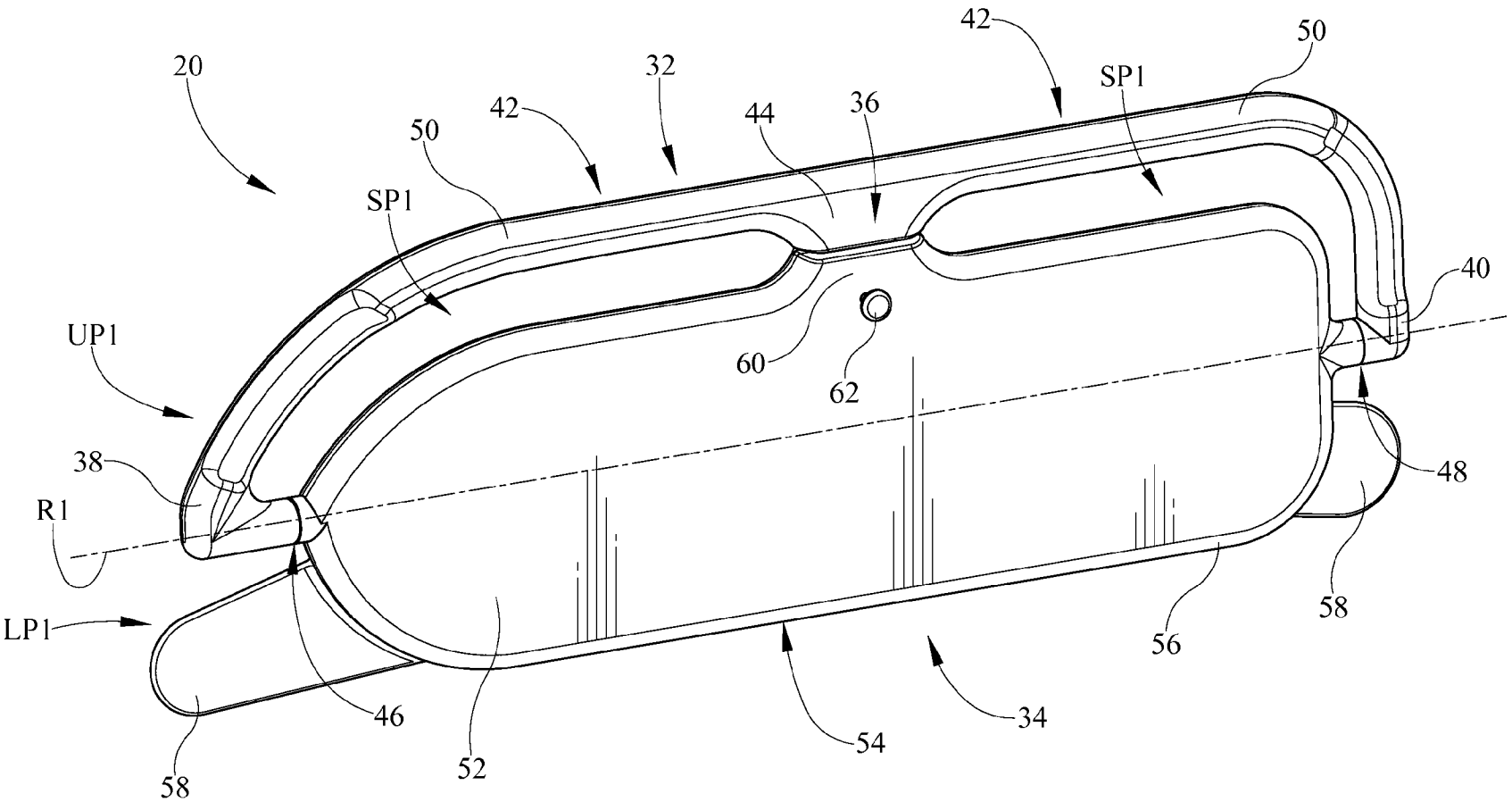
FIG. 5 is a perspective side view of the siderail body assembly of FIG. 1 showing the first body in the first position with respect to the second body.
Figure 6:
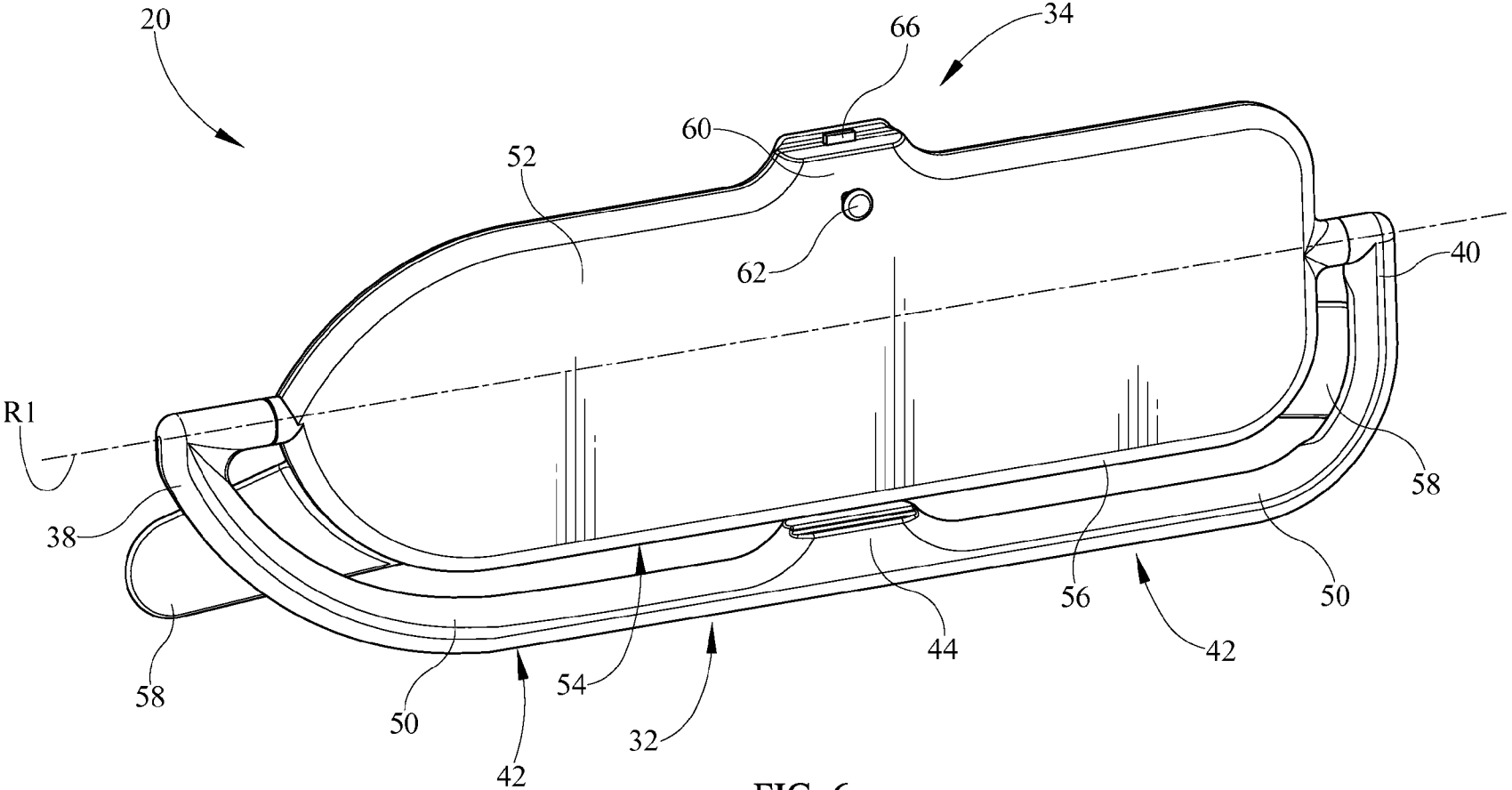
FIG. 6 is a perspective side view of the siderail body assembly of FIG. 1 showing the first body in the second position with respect to the second body.

The siderail body assembly 26 includes a first body 32, a second body 34, and a body locking mechanism 36 as shown in FIGS. 1-6. The first body 32 is movably coupled to the second body 34 and is configured to rotate between a first position and a second position with respect to the second body 34 about a rotational axis R1. In the first position, the first body 32 can be positioned above the second body 34 as shown in FIGS. 1, 3, and 5. In the second position, the first body 32 can be positioned below the second body 34 as shown in FIGS. 2, 4, and 6. In one illustrative embodiment the first body 32 rotates about 180° between the first position and the second position. The movement of the first body 32 with respect to the second body 34 allows for the height of the siderail body assembly 26 with respect to the upper frame 16 to be changed from a first height H1 to a second height H2 when the siderail body assembly 26 is in the deployed position. Also, the movement of the first body 32 with respect to the second body 34 allows for the height of the siderail body assembly 26 with respect to a floor to be changed from a third height H3 to a fourth height H4 when the siderail body assembly 26 is in the storage position.

The first body 32 includes a first end 38, a second end 40, a grip portion 42, and a first body mount 44 as shown in FIGS. 1-6. In one illustrative embodiment, the first body 32 is substantially U-shaped. The first end 38 is rotatably coupled to the second body 34 at a first joint 46 and the second end 38 is rotatably coupled to the siderail body 34 at a second joint 48. It should be appreciated that the rotational axis R1 passes through the first joint 46 and the second joint 48. It should also be appreciated that the rotational axis R1 can pass through the second body 34 such that the second body 34 can be substantially symmetrical about the rotational axis R1. The grip portion 42 extends between the first end 38 and the second end 40 and is spaced apart from the second body 34 by spaces SP1 to define a pair of grips 50. The first body mount 44 is located between the grips 50 and is configured to engage a portion of the second body 34 and the body locking mechanism 36 in the first position. It should be appreciated that a portion of the first body mount 44 can be used as a grip.

The second body 34 includes a first surface 52, a second surface 54, a perimeter edge 56 extending between the first surface 52 and the second surface 54, lower stops 58, and an upper stop 60 as shown in FIGS. 1-6. The second body 34 is coupled to the movement mechanism 24 along the lower portion LP1 of the first body 32. The lower stops 58 extend from the sides of the lower portion LP1 and are configured to prevent the first body 32 from rotating to define the second position. It should be appreciated that the lower stops 58 can also be used to help reduce gaps between the siderails 20 and the endboards EB1 or adjacent siderails 20. The upper stop 60 is located along the upper portion UP1 of the first body 32 and is configured to engage the first body mount 44 of the first body 32. In one illustrative embodiment, the upper stop 60 and the first body mount 44 extend from the second body 34 and the first body 32, respectively, toward one another such that they engage one another when the first body is in the first position.

Figure 7:
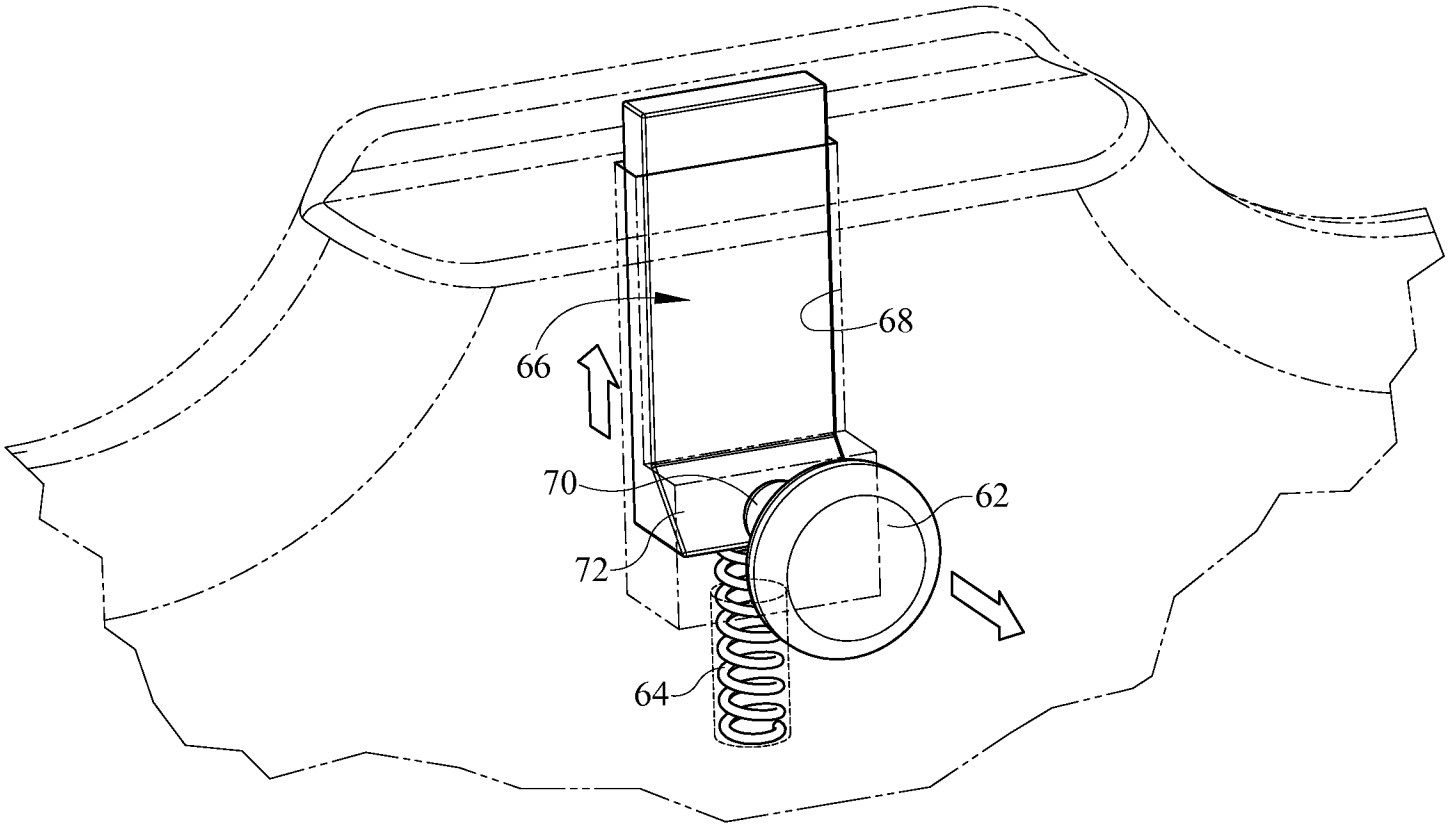
FIG. 7 is a perspective side view of the siderail of FIG. 1 showing a partial cut-away of the body locking mechanism in a first position configured to prevent movement of the first body with respect to the second body.
Figure 8:
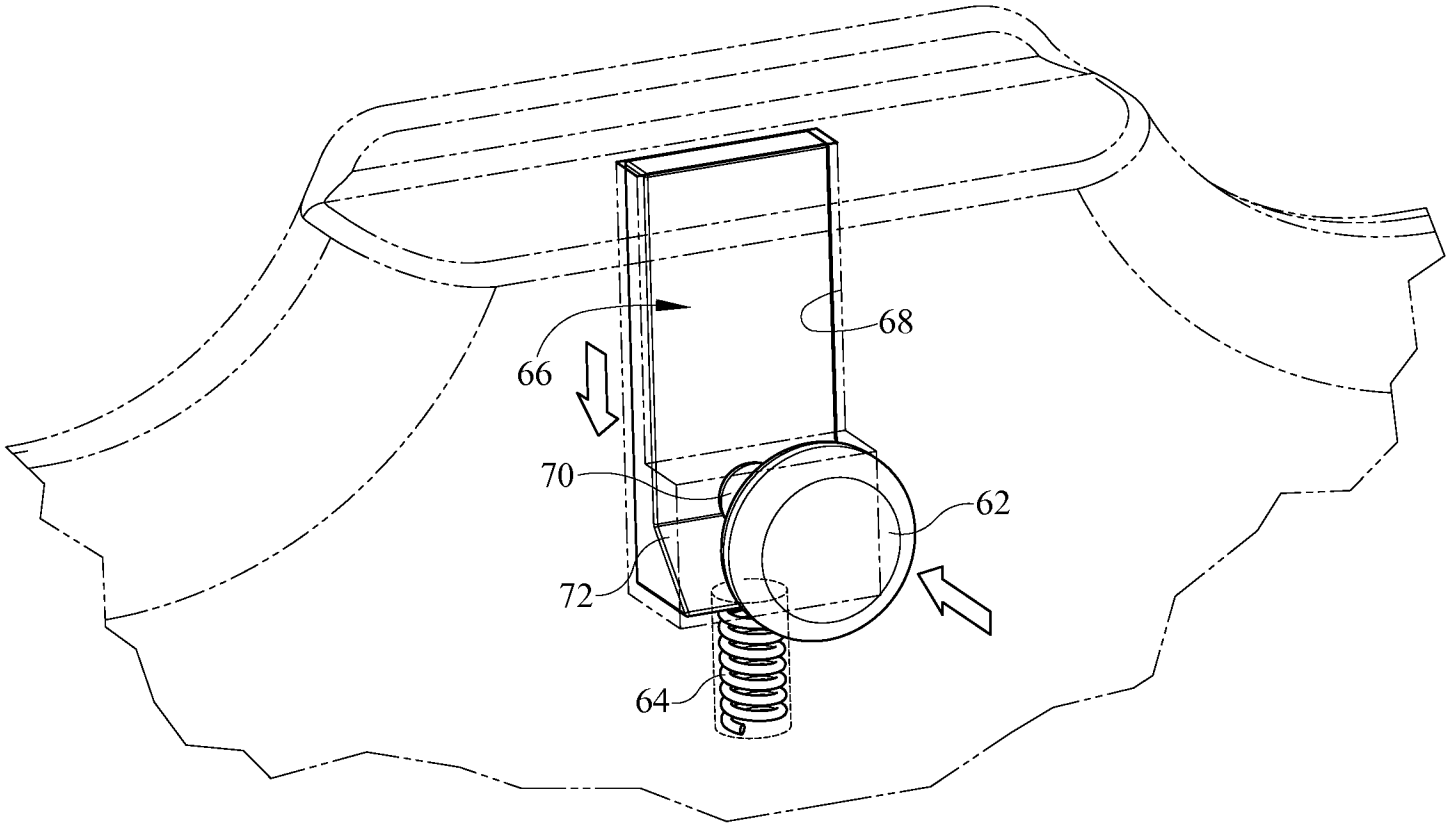
FIG. 8 is a perspective side view of the siderail of FIG. 1 showing a partial cut-away of the body locking mechanism in a second position configured to allow the first body to move with respect to the second body.

The body locking mechanism 36 is coupled to the upper stop 60 and is configured to selectively engage the first body mount 44 to maintain the first body 32 in the first position with respect to the second body 34. It should be appreciated that the lower stops 58 and/or the lower portion LP1 of the second body 34 can include a body locking mechanism 44 configured to maintain the first body 32 in the second position with respect to the second body 34. The body locking mechanism 36 includes a button 62, a spring 64, and a latch bolt 66 as shown in FIGS. 7-8. The spring 64 and the latch bolt 66 are positioned in a slot 68 in the upper stop 60. The latch bolt 66 is configured to move between a first position where the latch bolt 66 extends out of the slot 68 to engage the first body mount 44 and prevent the first body 32 from moving with respect to the second body 34, and a second position where the latch bolt 66 is retracted into the slot 68 such that the latch bolt 66 does not engage the first body mount 44 and the first body 32 is able to move with respect to the second body 34. The spring 64 is configured to bias the latch bolt 66 toward the first position. The button 62 is coupled to the upper stop 60 and includes a protrusion 70 extending from the button 62. The protrusion 70 is configured to engage a ramp 72 on the latch bolt 68 and move the latch bolt 66 from the first position toward the second position when the button 62 is pressed. It should be appreciated that the body locking mechanism 36 can include a spring (not shown) recessed into the upper stop 60 and configured to urge a sphere (not shown), such as, a ball bearing, into a recessed portion (not shown) of the first body mount 44. It should also be appreciated that the body locking mechanism 36 can be other locks, such as, for example, bolt locks, cam locks, and/or various friction locks.

In operation, the siderail 20 is initially positioned in the deployed position with the first body 32 in the first position with respect to the second body 34. The button 62 is pressed to retract the latch bolt 68 and allow the first body 30 to move with respect to the second body 34. As the first body 32 is rotated from the first position above the second body 34 to a second position below the second body 34, the height of the siderail body assembly 26 with respect to the upper frame 16 is reduced from the first height H1 to the second height H2. The change in height can help provide caregivers better access to a person supported on the person-support apparatus.

Also, in operation, the siderail 20 is initially positioned in the storage position with the first body 32 in the first position with respect to the second body 34. The button 62 is pressed to retract the latch bolt 68 and allow the first body 30 to move with respect to the second body 34. As the first body 32 is rotated from the first position above the second body 34 to a second position below the second body 34, the height of the siderail body assembly 26 with respect to the ground is reduced from the third height H3 to the fourth height H4. The change in height can help reduce incidences of the siderail body assembly 26 contacting the lower extremities of a person, such as, the underside of the person's thighs, when the person is seated along the edge of the person-support apparatus 10 and/or ingressing/egressing to/from the person-support apparatus 10.

Many other embodiments of the present disclosure are also envisioned. For example, a siderail assembly comprises a first siderail body and a second siderail body. The second siderail body is movably coupled to the first siderail body and configured to rotate between a first position and a second position with respect to the first siderail body about a rotational axis passing through the first siderail body. The second siderail body is positioned above the first siderail body in the first position and below the first siderail body in the second position.

In another example, a siderail assembly comprises a siderail body and a grip. The siderail body has an upper perimeter edge located along an upper portion of the siderail body. The grip has an upper grip edge located along the upper portion of the grip. The grip is movably coupled to the siderail body and configured to rotate between an first position and a second position with respect to the siderail body about a rotational axis. The upper grip edge is positioned above the upper perimeter edge of the siderail body in the first position and below the upper perimeter edge in the second position.

In yet another example, a person-support apparatus comprises a frame and a siderail. The siderail is movably coupled to the frame and includes a siderail body with a grip portion movably coupled thereto. The grip is configured to rotate between a deployed position and a storage position with respect to the siderail body about a rotational axis. The grip defines an uppermost surface of the siderail when the grip is in the first position and an upper portion of the siderail body defines the uppermost surface when the grip is in the second position.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described can be more desirable, it nonetheless can not be necessary and embodiments lacking the same can be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item can include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations can be apparent to those skilled in the art. Also, while multiple inventive aspects and principles can have been presented, they need not be utilized in combination, and various combinations of inventive aspects and principles are possible in light of the various embodiments provided above.

What is claimed is:

1. A siderail assembly, comprising:

a first siderail body; and a second siderail body movably coupled to the first siderail body and configured to rotate between a first position and a second position with respect to the first siderail body about a rotational axis passing through the first siderail body, wherein the second siderail body is positioned above the first siderail body in the first position and below the first siderail body in the second position, wherein a portion of the second siderail body and a portion of the first siderail body are spaced apart by an opening passing there between.

2. The siderail assembly of claim 1 further comprising a linkage assembly with a first end movably coupled to a structure and a second end coupled to the first siderail body, the linkage assembly being configured to move the first siderail body between a deployed position and a storage position with respect to the structure.

3. The siderail assembly of claim 2, wherein the linkage assembly includes a locking mechanism configured to maintain the first siderail body in at least one of the deployed position and the storage position.

4. The siderail assembly of claim 2, wherein the second siderail body moves independent of the linkage assembly.

5. The siderail assembly of claim 1 further comprising a locking mechanism configured to selectively maintain the second siderail body in at least one of the first position and the second position with respect to the first siderail body.

6. The siderail assembly of claim 1, wherein the second siderail body is a grip.

7. The siderail assembly of claim 1, wherein the first siderail body includes a plurality of stops extending therefrom that are configured to engage the second siderail body to define at least one of the first position and the second position.

8. The siderail assembly of claim 7, wherein the second siderail body includes a second siderail stop configured to engage at least one of the stops extending from the first siderail body.

9. The siderail assembly of claim 1, wherein the second siderail body is configured to rotate about 180°.

10. A siderail assembly, comprising:

a siderail body with an upper perimeter edge located along an upper portion of the siderail body and a lower perimeter edge located along a lower portion of the siderail body; and a grip with an upper grip edge located along an upper portion of the grip, the grip being movably coupled to the siderail body and configured to rotate between an first position and a second position with respect to the siderail body about a rotational axis, wherein the upper grip edge is positioned above the upper perimeter edge of the siderail body in the first position and below the lower perimeter edge in the second position.

11. The siderail assembly of claim 10, wherein the grip is positioned above the siderail body in the first position and below the siderail body in the second position.

12. The siderail assembly of claim 10, wherein the grip is configured to rotate about 180° with respect to the siderail body.

13. The siderail assembly of claim 10 further comprising a locking mechanism configured to selectively maintain the grip in at least one of the first position and the second position with respect to the siderail body.

14. The siderail assembly of claim 10, wherein the siderail body includes a plurality of stops extending therefrom that are configured to engage the grip to define at least one of the first position and the second position.

15. The siderail assembly of claim 10 further comprising:

a linkage assembly with a first end movably coupled to a structure and a second end coupled to the siderail body, the linkage assembly being configured to move the siderail body between a deployed position and a storage position with respect to the structure; and a locking mechanism configured to maintain the siderail body in at least one of the deployed position and the storage position.

16. A person-support apparatus, comprising:

a frame; and a siderail movably coupled to the frame and including a siderail body with a grip portion movably coupled thereto, the grip portion being configured to rotate between a deployed position and a storage position with respect to the siderail body about a rotational axis, the grip portion defining an uppermost surface of the siderail when the grip portion is in the first position and an upper portion of the siderail body defining the uppermost surface when the grip portion is in the second position, wherein the rotational axis is located below the uppermost surface.

17. The siderail assembly of claim 16 further comprising a support deck coupled to the frame, at least a portion of the grip portion being positioned above the deck when the siderail body is in a storage position with respect to the frame and the grip portion being positioned below the deck in the second position.

18. The siderail assembly of claim 16, wherein the uppermost surface is at a first height with respect to the frame when the grip portion is in the first position and at a second height with respect to the frame when the grip portion is in the second position.

19. The siderail assembly of claim 16, wherein the siderail includes a siderail linkage configured to couple the siderail body to frame and move the siderail body between a deployed position and a storage position with respect to the frame.

20. The siderail assembly of claim 19, wherein the frame supports a person-support surface thereon, the grip portion being positioned below the person-support surface when the grip portion is in the second position and the siderail body is in the storage position.

* * * * *